US011627397B1

(12) United States Patent
Filipek et al.

(10) Patent No.: US 11,627,397 B1
(45) Date of Patent: Apr. 11, 2023

(54) LOUDSPEAKER HAVING AN ANGLED HANDLE

(71) Applicant: Robert Bosch GmbH, Stuttgart (DE)

(72) Inventors: Shawn Filipek, Savage, MN (US); Nicholas Sulzer, Mosinee, WI (US); Andrew Grunloh, Columbia Heights, MN (US); Clifford Krapfl, Chicago, IL (US); Michael Herbert, Naperville, IL (US); Ross Brinkman, Chicago, IL (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/697,669

(22) Filed: Mar. 17, 2022

(51) Int. Cl.
*H04R 1/02* (2006.01)

(52) U.S. Cl.
CPC ..... *H04R 1/025* (2013.01); *H04R 1/023* (2013.01); *H04R 2201/029* (2013.01)

(58) Field of Classification Search
CPC ... H04R 1/025; H04R 1/023; H04R 2201/029
USPC ..... 381/332
See application file for complete search history.

(56) References Cited

U.S. PATENT DOCUMENTS

| | | | | |
|---|---|---|---|---|
| D484,115 | S | 12/2003 | Nishii et al. | |
| D609,217 | S | 2/2010 | Manini | |
| D611,452 | S | 3/2010 | Warden et al. | |
| D654,474 | S | 2/2012 | Hawkins et al. | |
| 8,126,180 | B2 | 2/2012 | Jacob et al. | |
| D682,250 | S | 5/2013 | Mattioli | |
| D695,269 | S | 12/2013 | Carpenter et al. | |
| D711,856 | S | 8/2014 | Kim et al. | |
| D771,585 | S | 11/2016 | Espinosa et al. | |
| 10,306,386 | B2 * | 5/2019 | Warden | H04R 27/00 |
| D875,715 | S | 2/2020 | Cheney | |
| 10,555,101 | B2 | 2/2020 | Warden et al. | |
| 2003/0174855 | A1 * | 9/2003 | Hawkins | H04R 1/02 381/386 |
| 2011/0019854 | A1 * | 1/2011 | Graber | H04R 1/30 181/152 |
| 2013/0177198 | A1 * | 7/2013 | Hogue | H04R 5/04 381/394 |
| 2015/0201255 | A1 * | 7/2015 | Porter | H04R 1/02 381/334 |

* cited by examiner

*Primary Examiner* — Sean H Nguyen
(74) *Attorney, Agent, or Firm* — Michael Best & Friedrich LLP

(57) ABSTRACT

A loudspeaker includes an enclosure having an open front side and a rear side opposite the front side, a bottom side, a top side opposite the bottom side, and a pocket open to the top side and open to the rear side. The pocket has an inner surface which is angled from the front side and the top side toward the rear side and the bottom side. The loudspeaker includes an audio transducer positioned within the enclosure and configured to emit sound from the front side of the enclosure, and a handle coupled to the enclosure, arranged at least partially within the pocket, and having a first portion elongated in a first direction and a second portion elongated in a second direction which is angled with respect to the first direction. The first portion includes a curved surface facing the pocket and terminating at lateral edges of the first portion.

20 Claims, 5 Drawing Sheets

LOUDSPEAKER HAVING AN ANGLED HANDLE

BACKGROUND

The present invention relates generally to the field of loudspeakers such as those used in small and large venues for public address and/or delivery of a musical performance to an audience.

SUMMARY

In one aspect, the invention provides a loudspeaker including an enclosure defining an open front side. The enclosure has a rear side opposite the open front side, a bottom side, a top side opposite the bottom side, and a pocket open to the top side and open to the rear side. The pocket has an inner surface which is angled from the open front side and the top side toward the rear side and the bottom side. The loudspeaker also includes an audio transducer positioned within the enclosure and configured to emit sound from the open front side of the enclosure, and a handle coupled to the enclosure and arranged at least partially within the pocket. The handle has a first portion elongated in a first direction and a second portion elongated in a second direction which is angled with respect to the first direction. The first portion includes a curved surface facing the pocket, and the curved surface terminates at lateral edges of the first portion.

In another aspect, the invention provides a loudspeaker including an enclosure defining an open front side and having a rear side opposite the open front side, a bottom side, a top side opposite the bottom side, and a pocket open to the rear side and to the top side. The pocket has a back end adjacent the rear side, a front end of the pocket opposite the back end, and an inner surface of the pocket which is angled from the open front side and the top side toward the rear side and the bottom side. The pocket has a first wall of the pocket extending from the inner surface to the top side and extending between the front end and the back end of the pocket, and a second wall of the pocket opposite the first wall, extending from the inner surface to the top side and extending between the front end and the back end of the pocket. The loudspeaker includes an audio transducer positioned within the enclosure and configured to emit sound from the open front side of the enclosure, and a handle arranged at least partially within the pocket. The handle has a first end coupled to the enclosure adjacent front end of the pocket and a second end coupled to the inner surface of the pocket adjacent the rear end of the pocket. The handle has a first portion including the first end and elongated in a first direction and a second portion including the second end and elongated in a second direction which is different from the first direction. The second end of the handle is spaced from the first wall and the second wall so that the inner surface extends to and is open to the rear side on each of a pair of lateral sides of the handle and so that a first channel is formed between the handle and the first wall and a second channel is formed between the handle and the second wall.

In yet another aspect, the invention provides a loudspeaker including an enclosure defining an open front side and having a rear side opposite the open front side, a bottom side, a top side opposite the bottom side, and a pocket in the top side and open to the rear side. The pocket has an inner surface which is inclined from the open front side and the top side toward the rear side and the bottom side. The loudspeaker has an audio transducer positioned within the enclosure and configured to emit sound from the open front side of the enclosure, and a handle coupled to the enclosure and arranged at least partially within the pocket. The handle has a first portion elongated in a first direction and a second portion elongated in a second direction which is different from the first direction. The first portion includes a first curved surface facing the pocket. The first curved surface terminates at lateral edges of the first portion. The inner surface extends to and is at least partially open to an exterior of the loudspeaker adjacent the rear side.

Other aspects of the invention will become apparent by consideration of the detailed description and accompanying drawings.

DETAILED DESCRIPTION

Figure 1:
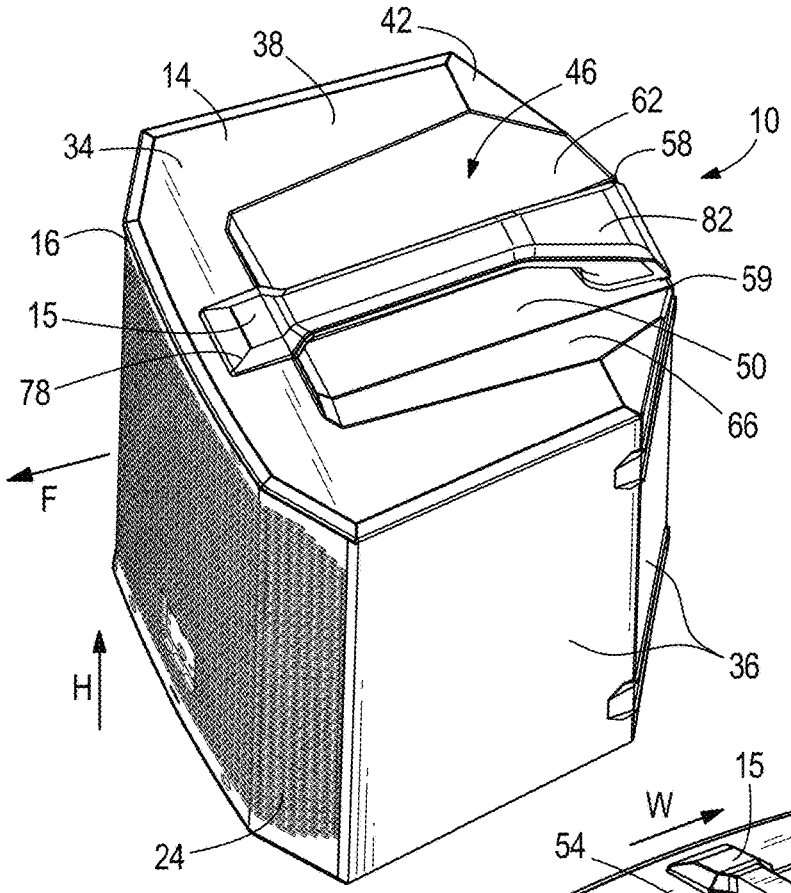
FIG. 1 is a perspective view of a loudspeaker according to one embodiment of the present disclosure.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

A loudspeaker 10, as shown in FIGS. 1-3 and 5, includes an enclosure 14 and a handle 15 coupled to the enclosure 14. The enclosure 14 has an open front side 16 defining a forward direction F for projecting sound. The loudspeaker 10 additionally includes a first audio transducer 18 positioned within the enclosure 14, a second audio transducer 20 positioned within the enclosure 14, and a baffle 22 securing the first audio transducer 18 and the second audio transducer 20 to the enclosure 14. The baffle 22 is positioned in the enclosure 14 adjacent the open front side 16. The loudspeaker 10 also includes a grille 24 at least partially closing the open front side 16, although the grille 24 is sound transmissive so that sound from the transducers 18, 20 is projected through the grille 24. In some embodiments, the grille 24 covers the open front side 16 of the enclosure 14 and the baffle 22. The grille 24 may be a rigid or flexible grille material and may be positioned over the first transducer 18 and the second transducer 20.

The first transducer 18 and the second transducer 20 are capable of reproducing one or more acoustic signals within certain frequency ranges, frequency bands, or bandwidths. In some constructions, the second transducer 20 is a tweeter configured to output sound in a high-frequency register. In some constructions, the first transducer 18 is a woofer assembly configured to output sound in a lower frequency register than the second transducer 20. The first transducer 18 and the second transducer 20 emit sound in the forward direction F.

Figure 2:
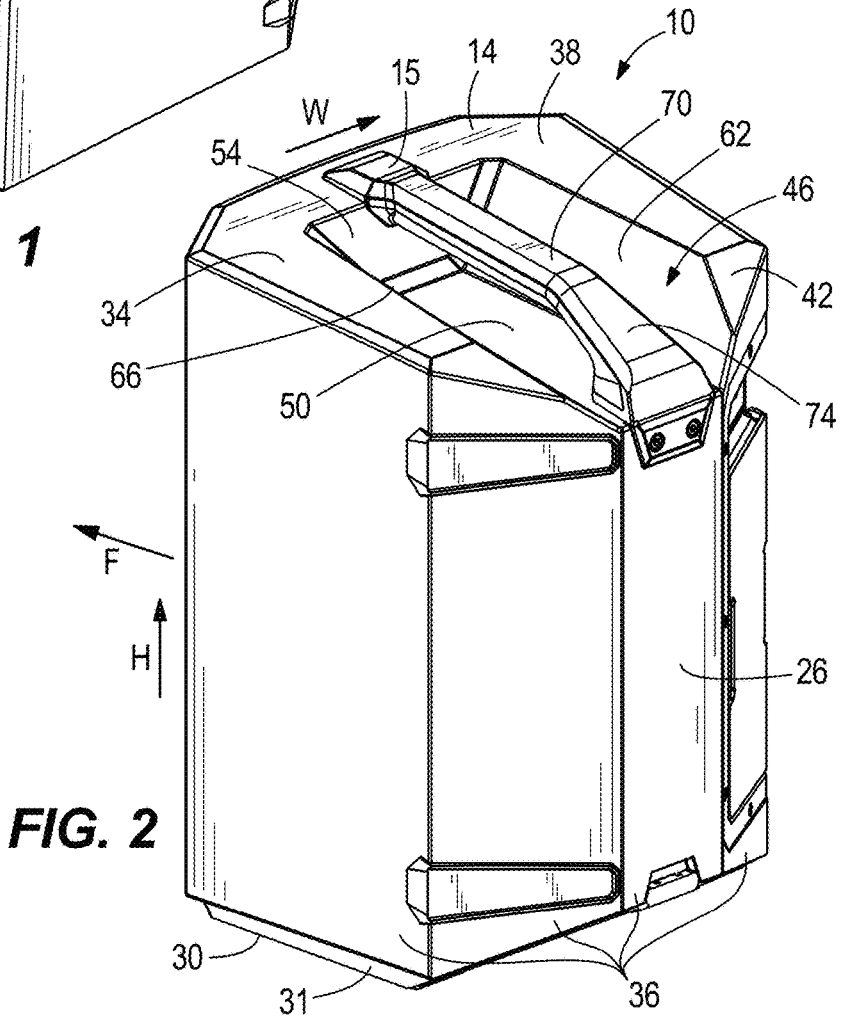
FIG. 2 is a rear perspective view of the loudspeaker of FIG. 1.
Figure 5:
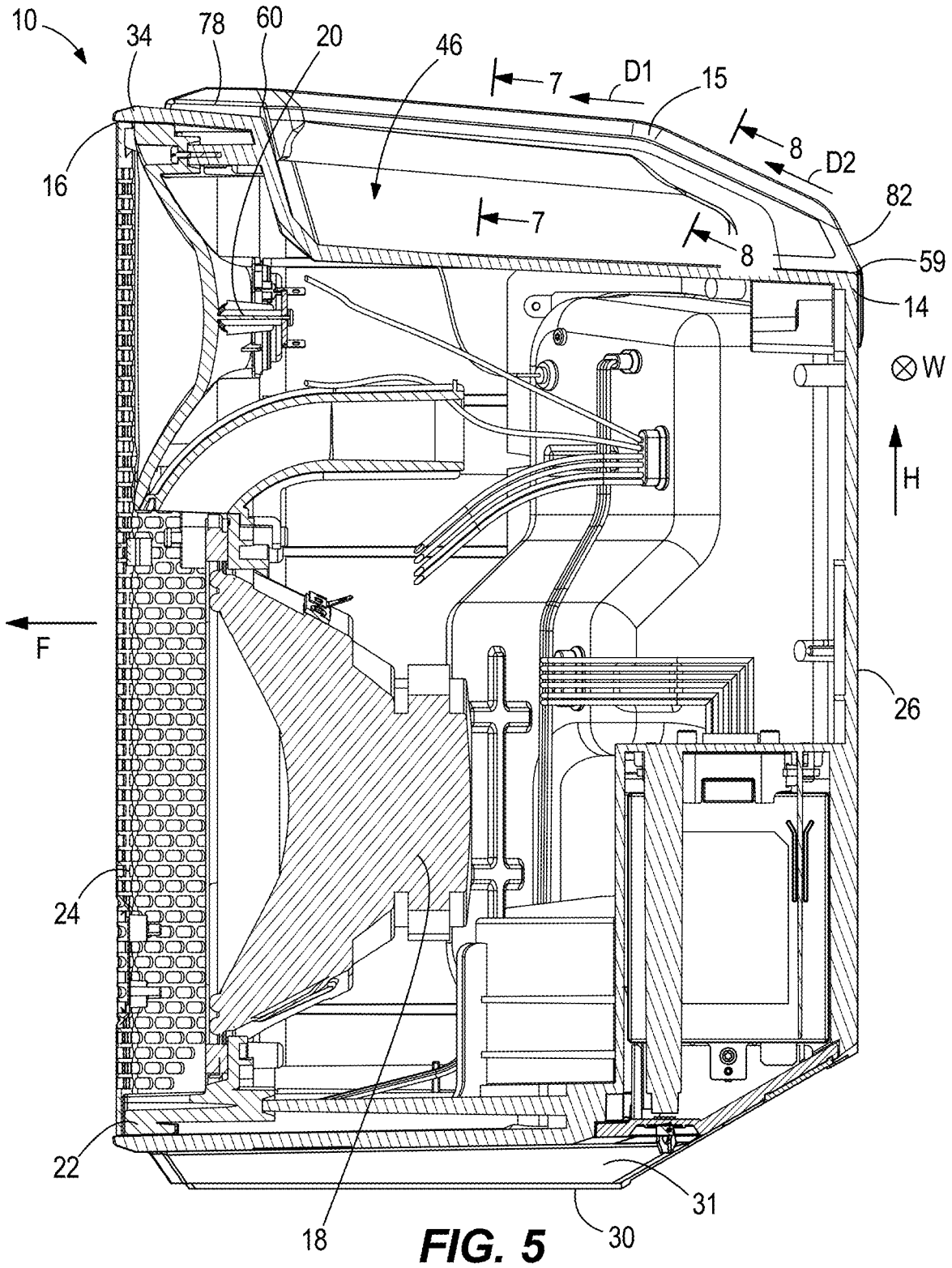
FIG. 5 is a cross-section view taken along the line 5-5 shown in FIG. 3.

With reference to FIGS. 1, 2 and 5, the enclosure 14 defines a rear side 26 opposite the open front side 16, a bottom side 30, and a top side 34 opposite the bottom side 30. The open front side 16 and the rear side 26 each extend between the top side 34 and the bottom side 30. The enclosure 14 includes a plurality of exterior walls 36 which in combination with the top side 34 and the bottom side 30 define an interior of the enclosure. Each of the exterior walls 36 extends between the top side 34 and the bottom side 30. One of the exterior walls 36 forms the rear side 26. The enclosure 14 has a polyhedron shape. In some embodiments, the enclosure 14 has a prismatic shape. The enclosure 14 defines a height direction H which is perpendicular to the forward direction F and which points from the bottom side 30 to the top side 34. The enclosure 14 also defines a width direction W which is perpendicular to the height direction H and the forward direction F.

The top side 34 includes a first section 38 adjacent the open front side 16 and a second section 42 adjacent the first section 38 and adjacent the rear side 26. The first section 38 is planar and is angled to the height direction H. The term "angled" can be understood to mean at an angle that is not 0 degrees or 180 degrees. The second section 42 includes two planar surfaces which are angled to the height direction H at a steeper angle than the first section 38. Thus, the second section 42 is angled to the first section 38. The bottom side 30 includes a plurality of feet 31 which are configured to support the loudspeaker 10 when the loudspeaker 10 is placed in an upright position.

Figure 3:
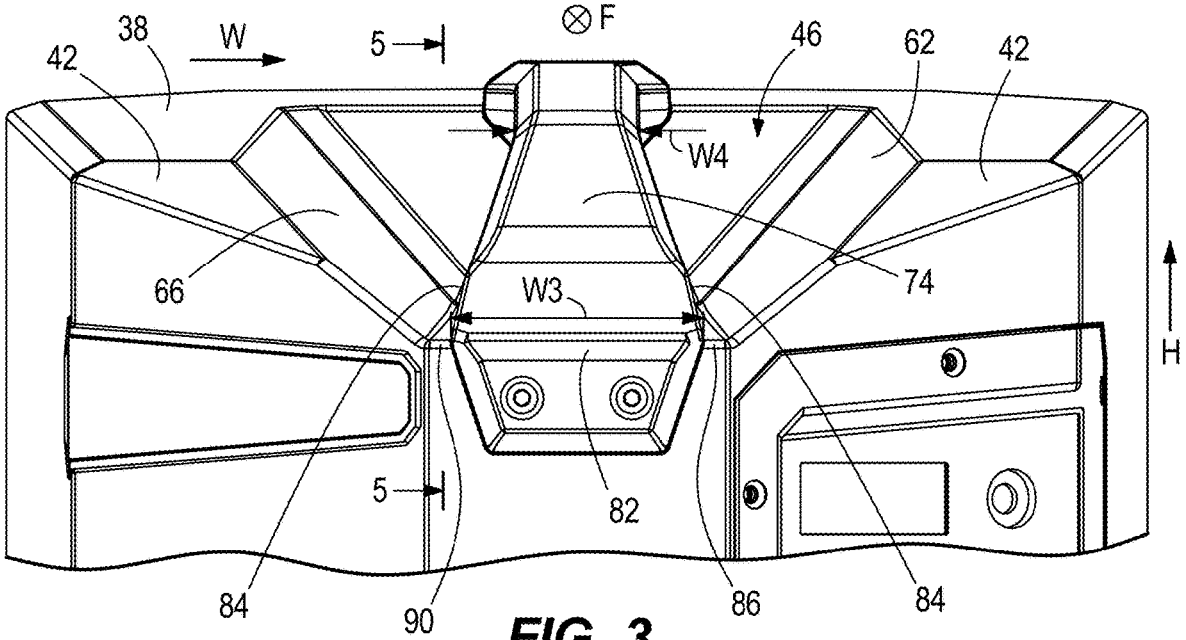
FIG. 3 is an enlarged rear view of the loudspeaker of FIG. 1.

As illustrated in FIGS. 1-3, the enclosure 14 defines a pocket 46 which is open to the top side 34 and the rear side 26. The pocket 46 is open to both the first section 38 and the second section 42 of the top side 34. The pocket 46 is additionally open to an edge between the top side 34 and the rear side 26. The pocket 46 is centered on the enclosure in the width direction W. The pocket 46 includes an inner surface 50 extending between a front end 54 of the pocket 46 and a back end 58 of the pocket 46. The inner surface 50 is angled from the open front side 16 and top side 34 toward the rear side 26 and the bottom side 30. The inner surface 50 extends to and is at least partially open to an exterior of the loudspeaker 10 adjacent the rear side 26. The inner surface 50 merges with the rear side 26 at a rear edge 59. The front end 54 of the pocket 46 merges with the enclosure top side 34 at a front edge 60. The front end 54 is opposite the back end 58 and is further in the forward direction F than the back end 58. The front end 54 is adjacent the open front side 16 of the enclosure 14. In some constructions, the pocket front end 54 is spaced from the open front side 16. In some constructions, the pocket front end 54 is within the forward-most one-third of the depth of the enclosure 14. In some constructions, the pocket front end 54 is within the forward-most one-fourth of the depth of the enclosure 14. The front end 54 is angled to the height direction H and the forward direction F. The back end 58 is adjacent the rear side 26 of the enclosure 14.

Figure 6:
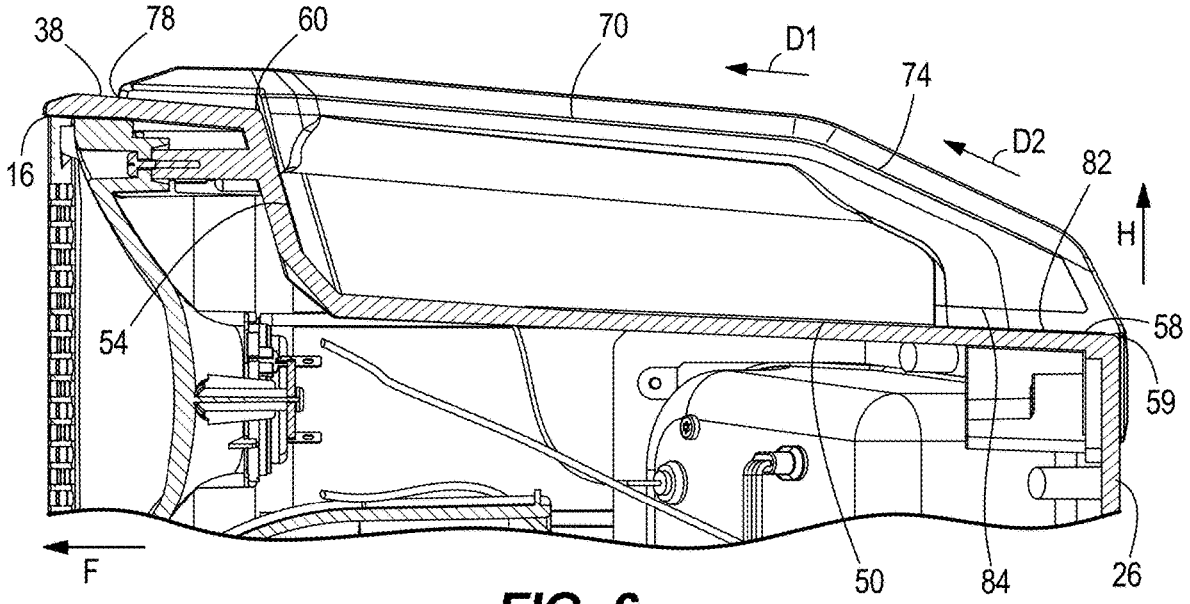
FIG. 6 is an enlarged cross-section view taken along the line 5-5 shown in FIG. 3.

The pocket 46 also includes a first wall 62 extending from the inner surface 50 to the top side 34 and a second wall 66 laterally opposed with the first wall 62 and extending from the inner surface 50 to the top side 34. The first wall 62 and the second wall 66 extend between the front end 54 and the back end 58. As shown in FIG. 3, the first wall 62 and the second wall 66 flare out from each other with increasing distance from the inner surface 50. In some constructions, the first wall 62 and the second wall 66 can be flat. In some constructions, the first wall 62 and the second wall 66 can be curved, With reference to FIGS. 3-6, the handle 15 is arranged at least partially in the pocket 46. In some constructions, a majority of the handle 15 is arranged in the pocket 46. In some constructions, along the length of the handle 15, at least 60% of the handle is below the top side 34 (see FIGS. 5 and 6). In some constructions, along the length of the handle 15, at least 70% of the handle 15 is below the top side 34. In some embodiments, the handle 15 can be arranged completely in the pocket 46. The handle 15 is centered on the enclosure 14 in the width direction W. The handle 15 includes a first portion 70 elongated in a first direction D1 and a second portion 74 elongated in a second direction D2 which is angled with respect to the first direction Dl. The first direction D1 and the second direction D2 are each angled to the forward direction F and the height direction H. The first portion 70 is longer than the second portion 74. The first portion 70 and the second portion 74 are formed as one-piece.

The first direction D1 and the second direction D2 are each angled to the forward direction F and to the height direction H. The first direction D1 and the second direction D2 each extend with components in the forward direction F and the height direction H. The second direction D2 extends further in the height direction H than the first direction D1 as the first and second directions D1, D2 extend in the forward direction F. In other words, a slope of the second direction D2, defined by the extension in the height direction H divided by the extension in the forward direction F, is greater than a slope of the first direction Dl. The first section 38 of the top side 34 follows the first direction D1 and the second section 42 of the top side follows the second direction D2. The term "follows" can be considered to mean within 5 degrees of.

The first portion 70 of the handle 15 is spaced from the inner surface 50, the first wall 62 and the second wall 66 so that a user has enough space to wrap their hand around the handle 15. The first direction D1 is parallel to the inner surface 50 of the pocket 46. The first portion 70 and the inner surface 50 are accordingly at a constant spacing to accommodate the hand of the user. The second portion 74 of the handle 15 is spaced from the inner surface 50, the first wall 62 and the second wall 66 so that a user has enough space to wrap their hand or a few fingers around the handle 15.

The handle 15 includes a first end 78 coupled to the enclosure 14 adjacent the front end 54 of the pocket 46 and a second end 82 coupled to the inner surface 50 of the pocket 46 adjacent the rear end 58 of the pocket 46. The first end 78 spans from the front end 54 to the top side 34 and over the front edge 60 of the pocket 46. The front edge 60 is received in the first end 78 of the handle 15. The second end 82 spans from the inner surface end 50 to the rear side 26 and over the rear edge 59 of the pocket 46. At least a portion of the rear edge 59 can be received in the second end 82 of the handle 15. The first portion 70 includes the first end 78 and the second portion 74 includes the second end 82. The first end 78 is coupled to the top side 34 of the enclosure 14. In some embodiments, the first end 78 is coupled to the first section 38 of the top side 34. In some embodiments, the first end 78 is coupled to the enclosure 14 adjacent the open front side 16 of the enclosure 14. The second end 82 is also coupled to the rear side 26 of the enclosure 14. In some embodiments, the second end 82 is only coupled to the inner surface 50 of the pocket 46.

The second end 82 of the handle 15 is spaced from the first wall 62 and the second wall 66 so that the inner surface 50 of the pocket 46 is open to the rear side 26 on each of a pair of lateral sides 84 (FIGS. 3 and 4) of the handle 15. One of the lateral sides 84 faces the first wall 62 and the other lateral side 84 faces the second wall 66. Accordingly, a first channel 86 is formed between the handle 15 and the first wall 62 and a second channel 90 is formed between the handle 15 and the second wall 66. The inner surface 50, the first channel 86, and the second channel 90 are configured to direct water out of the pocket 46. For example, the water may be rainwater when the loudspeaker 10 is placed outside. The water may be received from above into the pocket 46 and may be directed to the inner surface 50 via the first and second walls 62, 66. When the loudspeaker 10 is positioned so that the height direction H is directly opposite to gravity, the water is received in the pocket 46 and is directed toward the rear side 26 on the inner surface 50 via gravity because of the angle of the inner surface 50. The water exits the pocket 46 at the back end 58 through either or both of the first channel 86 or the second channel 90.

Figure 4:
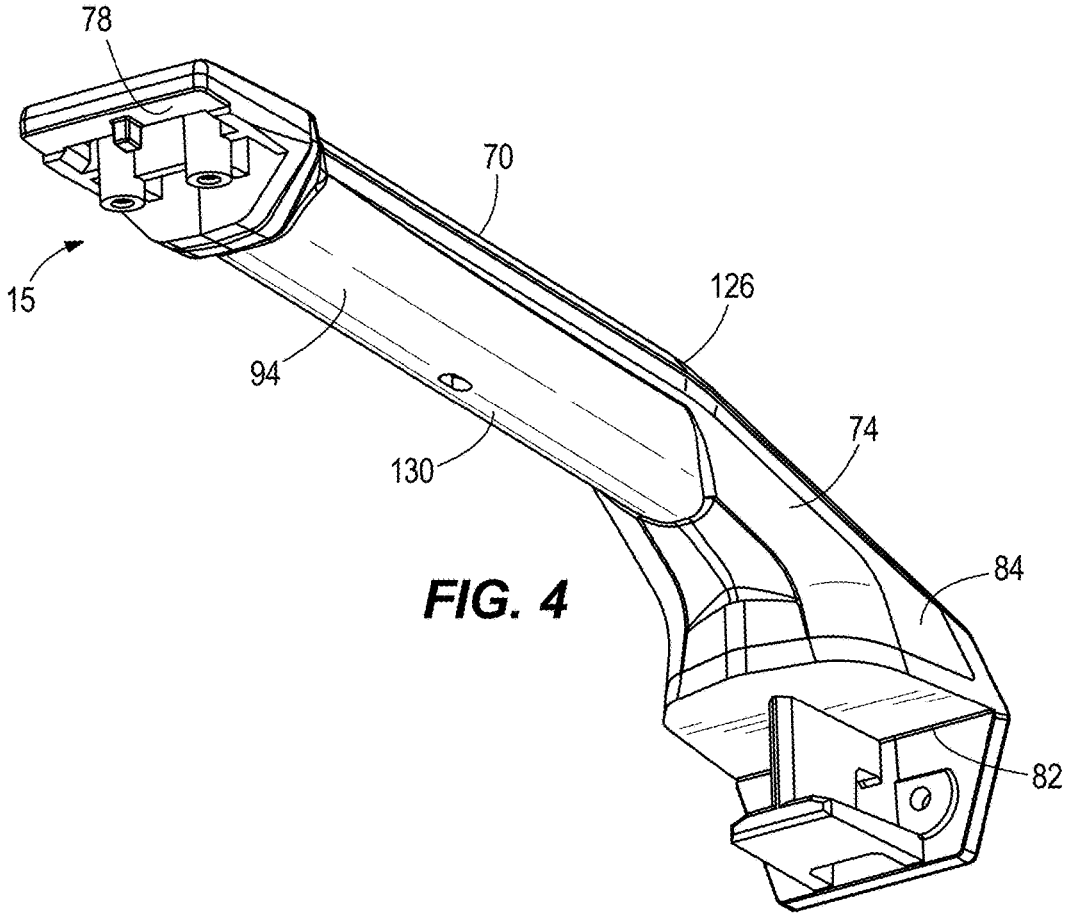
FIG. 4 is a perspective view of a handle of the loudspeaker of FIG. 1.
Figure 7:
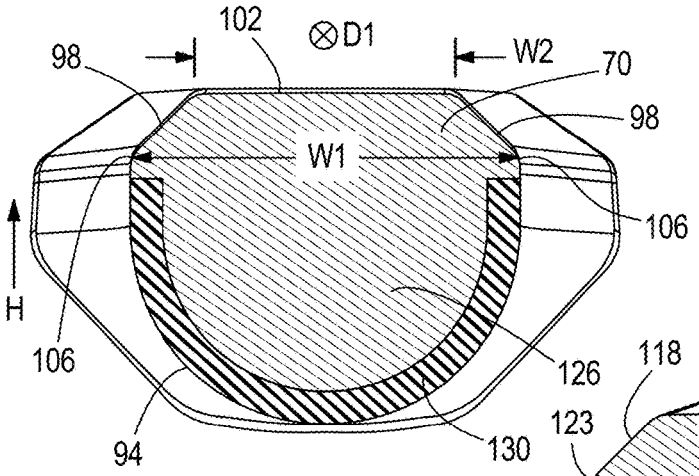
FIG. 7 is an enlarged cross-section view taken along the line 7-7 shown in FIG. 5.

FIG. 7 illustrates a cross-section of the first portion 70 of the handle 15 taken perpendicular to the first direction Dl. With reference to FIGS. 4 and 7, the first portion 70 of the handle 15 includes a curved surface 94 facing the pocket 46. The curved surface 94 has a U-shaped profile. In some constructions, the curved surface 94 is semi-circular or has a semi-circular portion. In some constructions, the curved surface 94 may have a constant radius. In some constructions, the curved surface 94 may have an increasing and decreasing radius. The curved surface 94 terminates at lateral edges 98 of the first portion 70. The lateral edges 98 each are elongated in the first direction Dl. Each of the lateral edges 98 has a straight profile. In some of the embodiments, each of the lateral edges 98 may have a curved profile. In some embodiments, the profile of the lateral edges 98 may be concave with respect to the exterior of the loudspeaker 10. The first portion 70 also includes a top surface 102 extending between the lateral edges 98. In some embodiments, the top surface 102 is planar. In some embodiments, the top surface 102 can be curved.

The curved surface 94 includes two corners 106, as viewed in the cross-section of FIG. 7, which adjoin the lateral edges 98. The corners 106 extend along the length of the lateral edges 98 and are elongated in the first direction Dl. The corners 106 define a first width W1 between the corners 106 extending in the width direction W. The first width W1 is constant along the length of the first portion 70. The lateral edges 98 define a second width W2 in the width direction W between the edges 98 where the lateral edges 98 adjoin the top surface 102. The second width W2 is constant along the length of the first portion 70. The first width W1 is larger than the second width W2.

Figure 8:
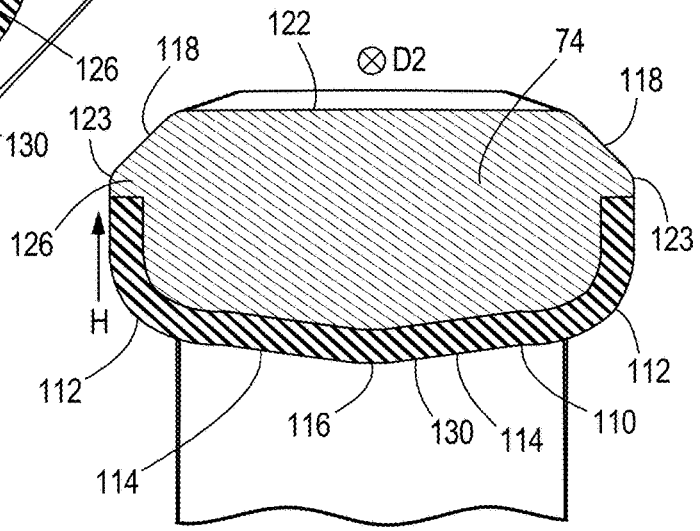
FIG. 8 is an enlarged cross-section view taken along the line 8-8 shown in FIG. 5.

FIG. 8 illustrates a cross-section of the second portion 74 of the handle 15 taken perpendicular to the second direction D2. With reference to FIGS. 3, 4 and 8, the second portion 74 includes a curved surface 110 facing the pocket 46. The curved surface 110 is U-shaped, but has a different profile from that of the curved surface 94 in the handle first portion 70. The curved surfaced 110 includes two outer segments 112, two inner segments 114, and a center segment 116. The segments 112, 114, 116 are continuous. The two outer segments 112 have a parabolic profile. The inner segments 114 have a straight profile. The center segment 116 has a curved profile. In some constructions, the curved surface 110 is semi-circular or has a semi-circular portion. In some constructions, the curved surface 110 may have a constant radius. In some constructions, the curved surface 110 may have an increasing and decreasing radius. In some constructions, the inner segments 114 may have a curved profile. The curved surface 94 of the first portion 70 and the curved surface 110 of the second portion 74 define an underside surface of the handle 15 which faces the pocket 46.

The curved surface 110 terminates at lateral edges 118 of the second portion 74. Each of the lateral edges 118 has a straight profile. In some of the embodiments, each the lateral edges 118 may have a curved profile. In some embodiments, the profile of the lateral edges 118 may be concave with respect to the exterior of the loudspeaker 10. The second portion 74 also includes a top surface 122 extending between the lateral edges 118 and facing away from the pocket 46. In some embodiments, the top surface 122 is planar. In some embodiments, the top surface 122 can be curved. The curved surface 110 includes two corners 123 which adjoin the lateral edges 118. The corners 123 extend along the length of the lateral edges 118.

The second portion 74 defines a third width W3 (FIG. 3) in the width direction W at the back end 58 of the pocket 46 and a fourth width W4 in the width direction W at an end of the second portion 74 which is connected to the first portion 70. The fourth width W4 is smaller than the third width W3. The fourth width W4 is equal to the first width W1 of the first portion 70. The third width W3 is the largest width of the second portion 74. The third width W3 is larger than the first width W1. The width of the second portion 74 increases with increasing distance toward the back end 58 of the pocket 46.

With reference to FIGS. 7 and 8, the handle 15 includes a rigid portion 126 and an overmold 130 molded over the rigid portion 126. The over-mold 130 is on the underside surface of the handle 15. Accordingly, the over-mold 130 is on the curved surfaces 94, 110 of the first portion 70 and the second portion 74. In some constructions, the overmold 130 is made of rubber and provides a non-slip surface on the handle 15. The non-slip surface aids the user in lifting the loudspeaker 10 by the handle 15 and prevents the handle 15 from slipping on the hand of the user. The overmold 130 is softer and more slip-resistant than the rigid portion 126. The rigid portion 126 defines the top surfaces 102, 122 and the lateral edges 98, 118 the first portion 70 and the second portion 74. The overmold 130 is substantially flush with the rigid portion 126. In some constructions, the overmold 130 may extend past the lateral edges 98, 118 and on to the top surfaces 102, 122.

Figure 9:
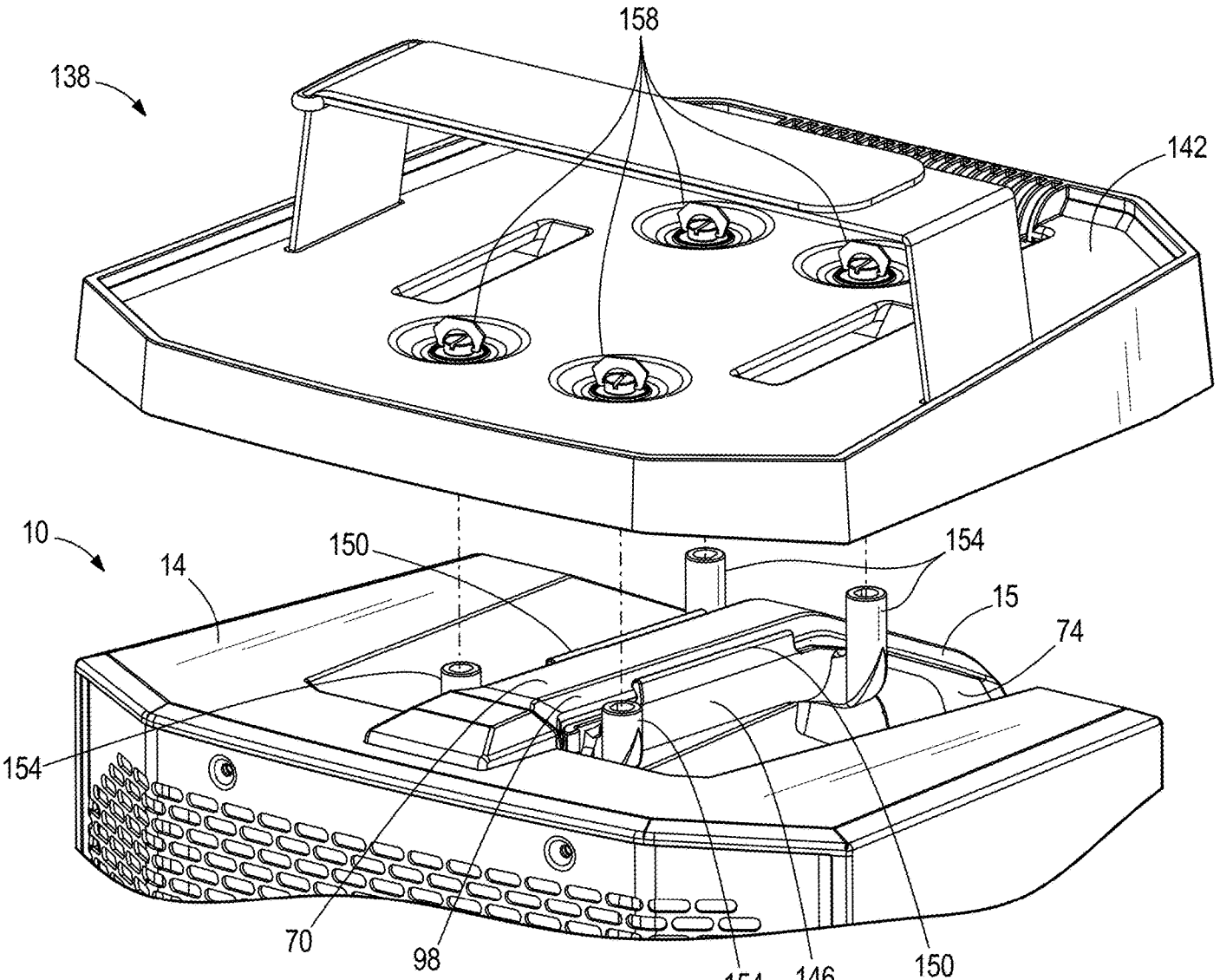
FIG. 9 is an enlarged exploded view of an accessory tray and the loudspeaker of FIG. 1.

With reference to FIG. 9, an accessory tray 138 may be removably secured to the loudspeaker 10. A variety of accessories, both electronic and otherwise, can be accommodated by the accessory tray 138. The accessory tray 138 includes a main portion 142 defining a space for the accessory and an anchor portion 146 that is configured to interface directly with the handle 15 of the enclosure. The anchor portion 146 can be mounted in a self-stable manner on the underside of the handle 15 via an interference fit. For example, the interference fit may be provided by a pair of opposed detent tabs 150 that can be situated along opposite sides of the handle 15 on the lateral edges 98 of the first portion 70. The lateral edges 98 are configured to retain the detent tabs 150 to prevent the anchor 146 from being removed from the handle 15. The anchor portion 146 wraps around the curved surface 94 of the first portion 70.

Further, the anchor portion 146 can include a plurality of fastener receiving portions 154 which are configured to received fasteners 158. The fasteners 158 extend through the main portion 142 and coupled to the main portion 142 and to the anchor 146 to hold the accessory tray 138 on the handle 15.

Various features of the invention are set forth in the claims below.

What is claimed is:

1. A loudspeaker comprising:

an enclosure defining an open front side and having a rear side opposite the open front side, a bottom side, a top side opposite the bottom side, and a pocket open to the top side and open to the rear side, the pocket having an inner surface which is angled from the open front side and the top side toward the rear side and the bottom side;

an audio transducer positioned within the enclosure and configured to emit sound from the open front side of the enclosure; and a handle coupled to the enclosure and arranged at least partially within the pocket, the handle having a first portion elongated in a first direction and a second portion elongated in a second direction which is angled with respect to the first direction, wherein the first portion includes a curved surface facing the pocket, and wherein the curved surface terminates at corners of the first portion.

2. The loudspeaker of claim 1, wherein the pocket includes a back end adjacent the rear side and a front end which is opposite the back end and is further in the forward direction than the back end, wherein the handle has a first end on the first portion coupled to the enclosure adjacent the front end of the pocket and has a second end on the second portion coupled to the inner surface of the pocket adjacent the back end of the pocket.

3. The loudspeaker of claim 2, wherein the pocket has a first wall extending from the inner surface to the top side, and a second wall laterally opposed with the first wall and extending from the inner surface to the top side, and wherein the second end of the handle is spaced from the first wall and the second wall so that the inner surface extends to and is open to the rear side on each of a pair of lateral sides of the handle.

4. The loudspeaker of claim 3, wherein the first wall and the second wall flare out from each other with increasing distance from the inner surface.

5. The loudspeaker of claim 1, wherein the corners adjoin lateral edges of the first portion and two upper ends of the curved surface of the first portion, wherein the first portion includes a top surface extending between and adjoining the lateral edges, wherein the upper ends define a first width and the lateral edges define a second width where the lateral edges adjoin the top surface, and wherein the first width is greater than the second width.

6. The loudspeaker of claim 1, wherein first portion of the handle is longer than the second portion of the handle.

7. The loudspeaker of claim 1, wherein the second portion includes a curved surface facing the pocket, and wherein the handle includes an over-mold on the curved surface of the first portion and the curved surface of the second portion.

8. A loudspeaker comprising:

an enclosure defining an open front side and having a rear side opposite the open front side, a bottom side, a top side opposite the bottom side, and a pocket open to the rear side and to the top side, the pocket having a back end adjacent the rear side, a front end of the pocket opposite the back end, an inner surface of the pocket which is angled from the open front side and the top side toward the rear side and the bottom side, a first wall of the pocket extending from the inner surface to the top side and extending between the front end and the back end of the pocket, and a second wall of the pocket opposite the first wall, extending from the inner surface to the top side and extending between the front end and the back end of the pocket;

an audio transducer positioned within the enclosure and configured to emit sound from the open front side of the enclosure; and a handle arranged at least partially within the pocket and having a first end coupled to the enclosure adjacent front end of the pocket and a second end coupled to the inner surface of the pocket adjacent the rear end of the pocket, the handle having a first portion including the first end and elongated in a first direction and a second portion including the second end and elongated in a second direction which is different from the first direction, wherein the second end of the handle is spaced from the first wall and the second wall so that the inner surface extends to and is open to the rear side on each of a pair of lateral sides of the handle and so that a first channel is formed between the handle and the first wall and a second channel is formed between the handle and the second wall.

9. The loudspeaker of claim 8, wherein the first portion includes a curved surface facing the pocket and terminating at corners of the first portion, wherein corners adjoin two upper ends of the curved surface and two lateral edges of the first portion, wherein the first portion includes a top surface extending between and adjoining the lateral edges, wherein the upper ends define a first width and the lateral edges define a second width where the lateral edges adjoin the top surface, and wherein the first width is greater than the second width.

10. The loudspeaker of claim 8, wherein the first portion of the handle is longer than the second portion of the handle.

11. The loudspeaker of claim 10, wherein the inner surface of the pocket is parallel to the first direction.

12. The loudspeaker of claim 8, wherein the handle includes an over-mold on an underside surface of the first portion and the second portion facing the pocket.

13. The loudspeaker of claim 8, wherein the first direction is angled from the open front side and the top side downward to the rear side and the bottom side, and wherein the second direction is angled steeper from the open front side and the top side downward to the rear side and the bottom side.

14. The loudspeaker of claim 13, wherein the first portion of the handle is longer than the second portion of the handle.

15. The loudspeaker of claim 8, wherein the first portion of the handle includes a curved surface facing the pocket and terminating at two lateral edges of the first portion.

16. A loudspeaker comprising:

an enclosure defining an open front side and having a rear side opposite the open front side, a bottom side, a top side opposite the bottom side, and a pocket in the top side and open to the rear side, the pocket having an inner surface which is angled from the open front side and the top side toward the rear side and the bottom side;

an audio transducer positioned within the enclosure and configured to emit sound from the open front side of the enclosure; and a handle coupled to the enclosure and arranged at least partially within the pocket, the handle having a first portion elongated in a first direction and a second portion elongated in a second direction which is different from the first direction, wherein the first portion includes a first curved surface facing the pocket, wherein the first curved surface terminates at lateral edges of the first portion, and wherein the inner surface extends to and is at least partially open to an exterior of the loudspeaker adjacent the rear side.

17. The loudspeaker of claim 16, wherein the first portion of the handle is longer than the second portion of the handle.

18. The loudspeaker of claim 16, wherein the inner surface of the pocket is parallel to the first direction.

19. The loudspeaker of claim 16, wherein the first direction is angled from the open front side and the top side downward to the rear side and the bottom side, and wherein the second direction is angled steeper from the open front side and the top side downward to the rear side and the bottom side.

20. The loudspeaker of claim 16, wherein the handle includes an over-mold on an underside surface of the first portion and the second portion facing the pocket, and wherein the underside surface includes the first curved surface.

* * * * *